United States Patent [19]

Soot

[11] Patent Number: 4,594,044

[45] Date of Patent: Jun. 10, 1986

[54] ROTATING TRUCK LIFT

[76] Inventor: Olaf Soot, 9 Tomahawk La., Greenwich, Conn. 06830

[21] Appl. No.: 521,278

[22] Filed: Aug. 8, 1983

[51] Int. Cl.[4] ..... E04H 6/08

[52] U.S. Cl. ..... 414/263; 414/672

[58] Field of Search ..... 414/227, 228, 242, 244, 414/247, 249, 250, 261, 263, 253, 264, 234, 251, 672

[56] References Cited

U.S. PATENT DOCUMENTS

| | | | |
|---|---|---|---|
| 1,932,446 | 10/1933 | Cain, Sr. | 414/242 |
| 1,966,165 | 7/1934 | Clyde | 414/263 |
| 2,691,448 | 10/1954 | Lontz | 414/263 X |
| 2,847,131 | 8/1958 | Miller | 414/264 X |
| 3,055,517 | 9/1962 | Kirkland | 414/249 |
| 3,382,990 | 5/1968 | Salloum | 414/261 X |
| 3,395,815 | 8/1968 | Johnson | 414/247 X |
| 3,613,908 | 10/1971 | Mulitz | 414/242 X |
| 3,710,956 | 1/1973 | Meyer et al. | 414/249 X |
| 4,190,013 | 2/1980 | Otis et al. | 414/253 |
| 4,264,257 | 4/1981 | Saurwein | 414/263 X |

*Primary Examiner*—Joseph E. Valenza
*Assistant Examiner*—David A. Bucci
*Attorney, Agent, or Firm*—Yuter, Rosen & Dainow

[57] ABSTRACT

A rotating truck lift structure integral with a building to facilitate delivery truck accessing of multiple internal loading and unloading docks via a narrow street entranceway.

19 Claims, 7 Drawing Figures

ROTATING TRUCK LIFT

This invention relates to rotating lift structures, and in particular to a rotating lift structure integral with a building to facilitate delivery truck accessing of multiple internal loading and unloading docks.

BACKGROUND OF THE INVENTION

When a building requires multiple docks for loading and unloading delivery trucks, it is conventional to provide the docks at street level. This has the disadvantages of increasing traffic congestion on the street bordering the docks, detracting from the appearance of the building at the dock area, and preventing the use in a city of typically high-rent, street-level space for more beneficial purposes.

BRIEF SUMMARY OF INVENTION

My invention is based on the concept of locating the loading and unloading docks inside or adjacent the building at a level below or above street level, and providing in or adjacent the building a rotating truck lift structure between a truck entrance and exit at street level and the loading dock level, for moving the delivery trucks from street level to loading dock level for loading and unloading of the trucks. More particularly, my invention utilizes a lift, mounted inside a rotating structure, to move the trucks from street to the loading dock level and rotate them in position so that they can back up from the lift straight into any desired loading dock. Preferably, the rotating truck lift structure is designed to minimize the space requirement at the street level as only slightly more than the width of the lift platform is required for the entrance. My invention thus reduces the number of docks required for street level loading to a single entrance and permits the use of high-rent street-level space for more beneficial purposes. It also reduces the traffic congestion associated with street-level loading docks, and does not detract from building appearance at the truck entrance.

DESCRIPTION OF DRAWINGS

My invention will now be described in connection with one exemplary embodiment thereof, taken in conjunction with the accompanying drawings, wherein.

DETAILED DESCRIPTION OF PREFERRED EMBODIMENT

Figure 1:
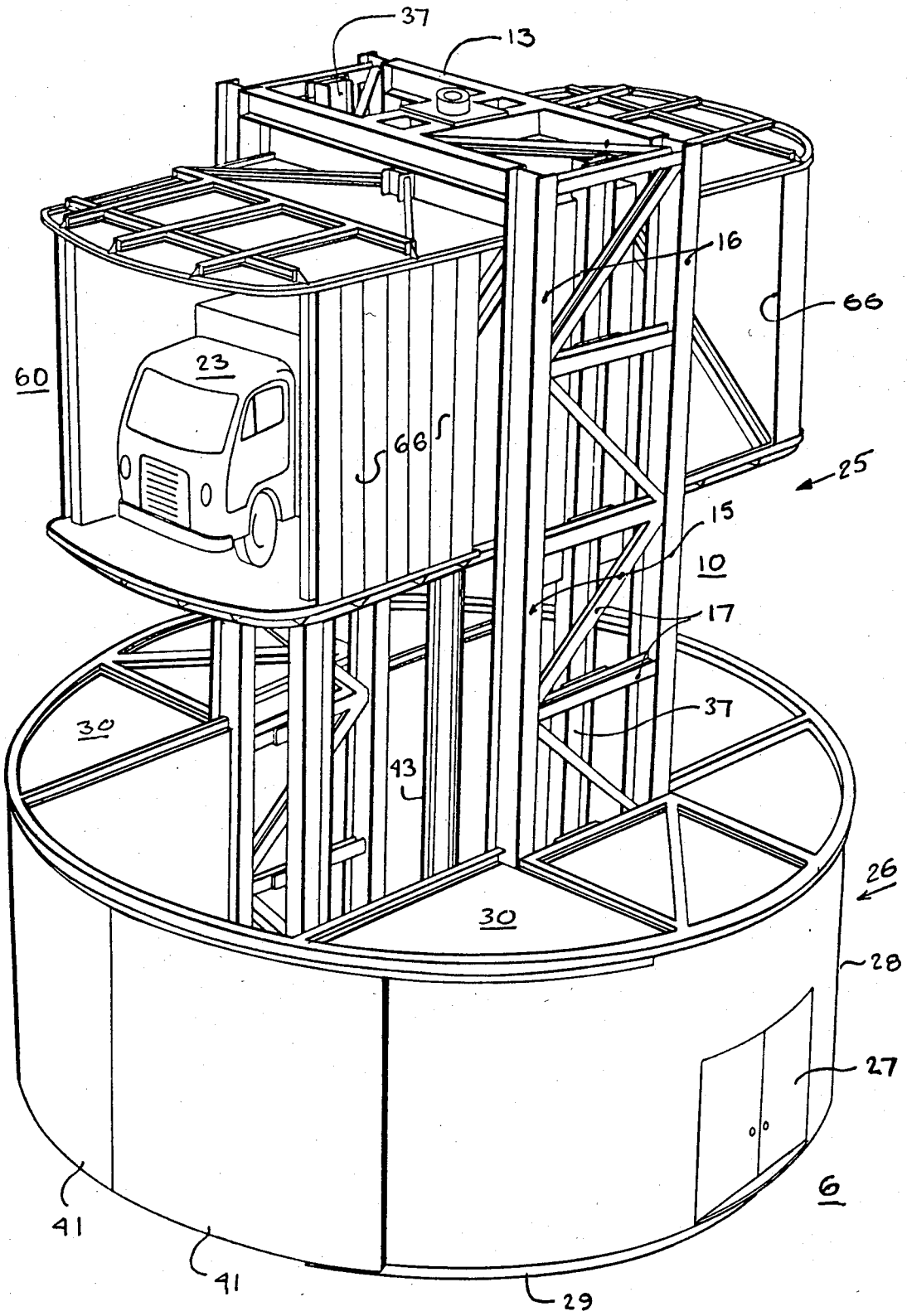
FIG. 1 is a perspective view of a preferred embodiment of my novel rotating lift, shown with the lift at street level.

Referring now to the drawings, FIG. 1 illustrates, in perspective, a view of my rotating lift structure mounted within a building (not shown in FIG. 1) with reference to an upper street level and to an internal loading/unloading dock level located below street level.

The rotating lift structure as installed is more clearly depicted in FIGS. 2–5. It comprises a vertically oriented tower structure 10 mounted within a building 11 (see also FIG. 7) adjacent to a truck entrance or exit 12 at street level 5 and which would be typically closed off by doors 52 and 53. Door 52 would be used for normal operation. Door 53 may be used as a secondary door, closing the building during periods of inactivity or it can be used instead of door 52 in case of door 52 failure. The tower 10 comprises two rectangular truss side structures 15 formed by vertical steel beams 16 with reinforcing cross structural members 17, one top structural frame 13 and one bottom structural frame 14, all joined together at their corners by rigid connections so as to form a rigid lower structure having a width 18 which is slightly larger than the width of lift platform 60, a height 20 extending approximately from the top 21 of the building street level 5 to below the bottom 22 of the dock level 6, and a depth 24 sufficient to provide a strong horizontal support for lift platform 60 throughout its travel from street level 5 to dock level 6. Typical dimensions would be, for example, a width 18 of about 20 feet, a height 20 of 46 feet, and a depth 24 of 9 feet.

The tower 10 is divided into street level and dock level sections, in the particular embodiment, an upper section 25 and a lower section 26. The upper section 25 consists essentially of just the trusses 15 and top structural frame 13 arranged so that the minimum amount of space at street level is occupied by the tower. The trusses 15 are continuous through the lower section 26, at dock level 6 and are tied together at their bottom ends by bottom structural frame 14. A structure 28, generally cylindrical in configuration, is secured to the trusses 15, and is formed by a structural framegrid 29 secured to and supported by the tower trusses 15. The structure 28 encloses hollow spaces 30 which can be conveniently used to house the lift machinery 31 to be later described, and if desired the turntable drive machinery 32, also to be later described. Suitable access doors 27 can be provided to the spaces 30.

Suitable doors, shown as horizontal bi-parting doors 41, are mounted at opposite ends of the lower cylindrical section 26 at locations opposite the lift platform 60 ends. These doors are closed when lift platform 60 is not at the loading dock 6 level so as to protect operating personnel. Doors 41 are opened only for entering and exiting trucks when lift platform 60 is at loading dock level 6. The entire tower structure 10, which includes the upper section 25 and the lower cylindrical section 26, is supported for rotation by the large diameter anti-friction bearing 45 at its bottom, mounted into a steel housing secured to the building in pit 46. This lower bearing 45 carries all the vertical loads and the bottom horizontal loads. In the preferred configuration, this lower bearing 45 also supports the hydraulic lift cylinder 38 which rotates together with the tower 10. A top bearing 47 is mounted on top of the tower and is also secured to the building at 48 and is designed to hold the tower in precise vertical position by transferring the top horizontal loads to the building structure. The top of the rotating tower structure at its upper section 25 is located closely around the center frame 61 of the lift platform so that it can rotate (assuming the lift platform is at dock level 6) freely inside the narrow, long hoistway 50 provided by building walls 51 at street level 5, which generally conforms to the shape of the lift platform, thereby requiring the minimum space within the building at street level 5. The lower cylindrical section 26 of the tower has a diameter slightly larger than the lift platform 60 length, and rotates within the building space at the dock level 6, only when lift platform 60 is at loading dock level 6.

A lift platform 60 is mounted within the tower structure 10 so as to be vertically movable therein. For this purpose, lift platform center frame 61 is conveniently configured at its edges so as to mount guide wheels or guide shoes 65 to engage vertical guide rails 37 arranged along opposite sides of the trusses 15.

The lift platform 60 has a generally rectangular configuration with a width slightly smaller than the tower structure 10 width sufficient to accommodate the maximum truck width, and a length designated 49 which extends generally perpendicular to the vertical plane of the frame and is chosen to accommodate the maximum truck length expected to be encountered.

Lift platform 60 in its preferred configuration is a double cantilever structure supported from its center frame 61. Lift platform center frame 61 is a rigid steel structure, supported and lifted at its bottom by hydraulic piston 43 and held level by guides 65 at four corners, engaging guide rails 37. Lift platform floor structures 63 are connected to center frame 61 at one end and are supported from center frame 61 by diagonal tension members 62 at their other (outside) ends.

Figure 4:
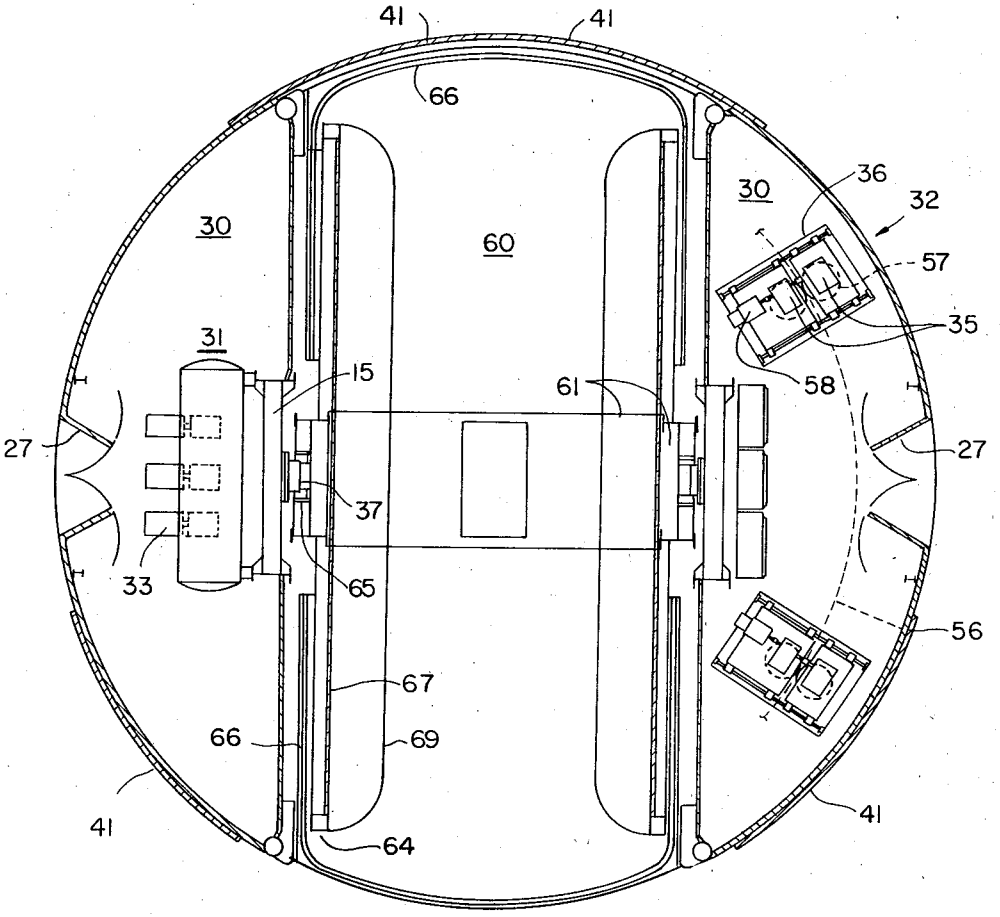

The lift platform may, if desired, be conveniently enclosed by side walls 67 and a ceiling member 68 supported by center frame 61 and by posts 64. The posts 64 can be further designed as bumpers against accidental truck impact. Raised curbs 69 can be added to floor structure 63 and center frame 61. Suitable bi-parting doors 66 are also provided to close off opposite ends of the thus formed truck enclosure. In FIG. 4, the doors are shown open at the bottom and closed at the top of the figure.

Figure 2:
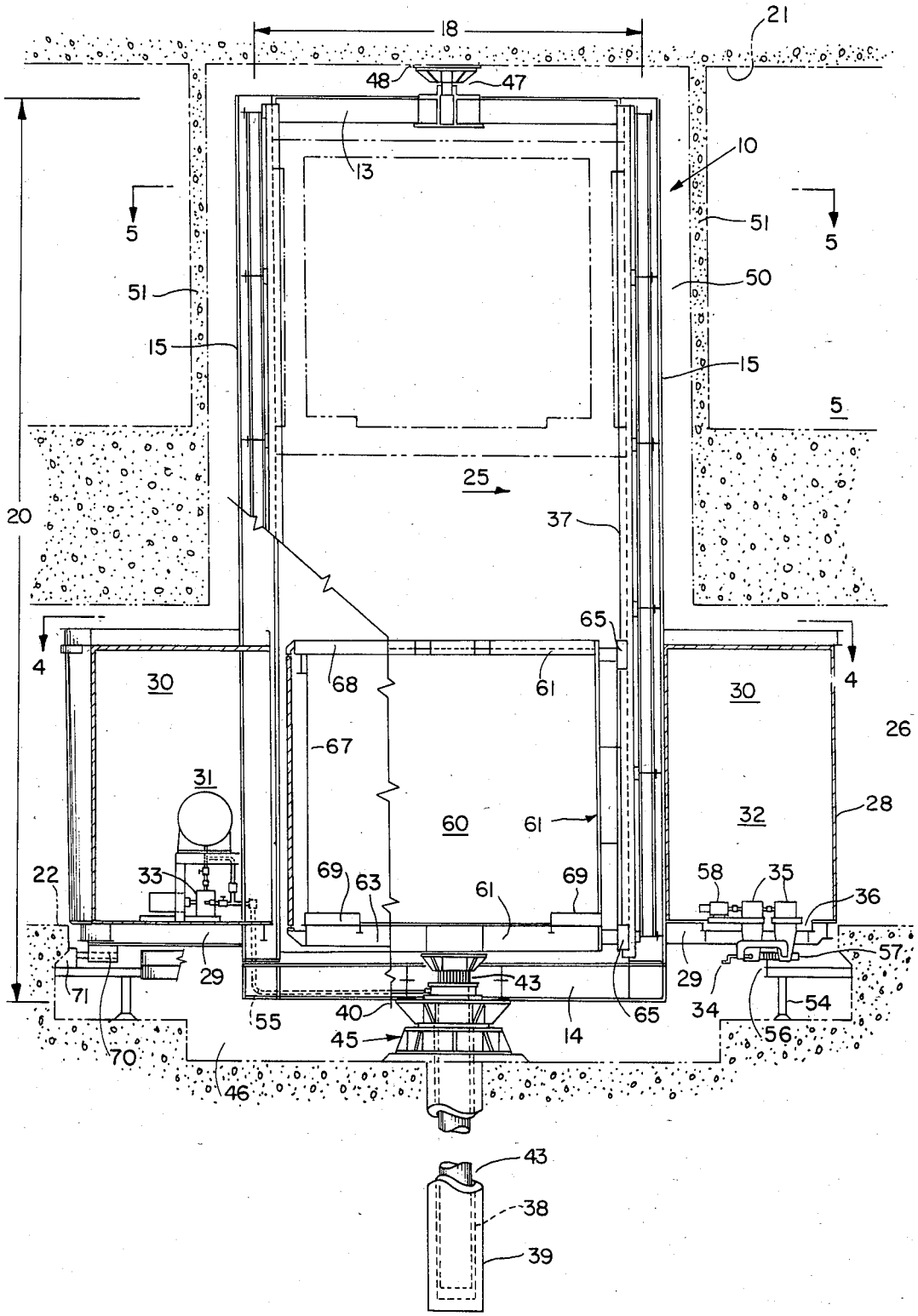
FIG. 2 is a vertical front view, partly sectional and partly schematic, of the rotating lift of FIG. 1 mounted in a building, with lift shown in solid lines at the dock level and in phantom at the street level.
Figure 3:
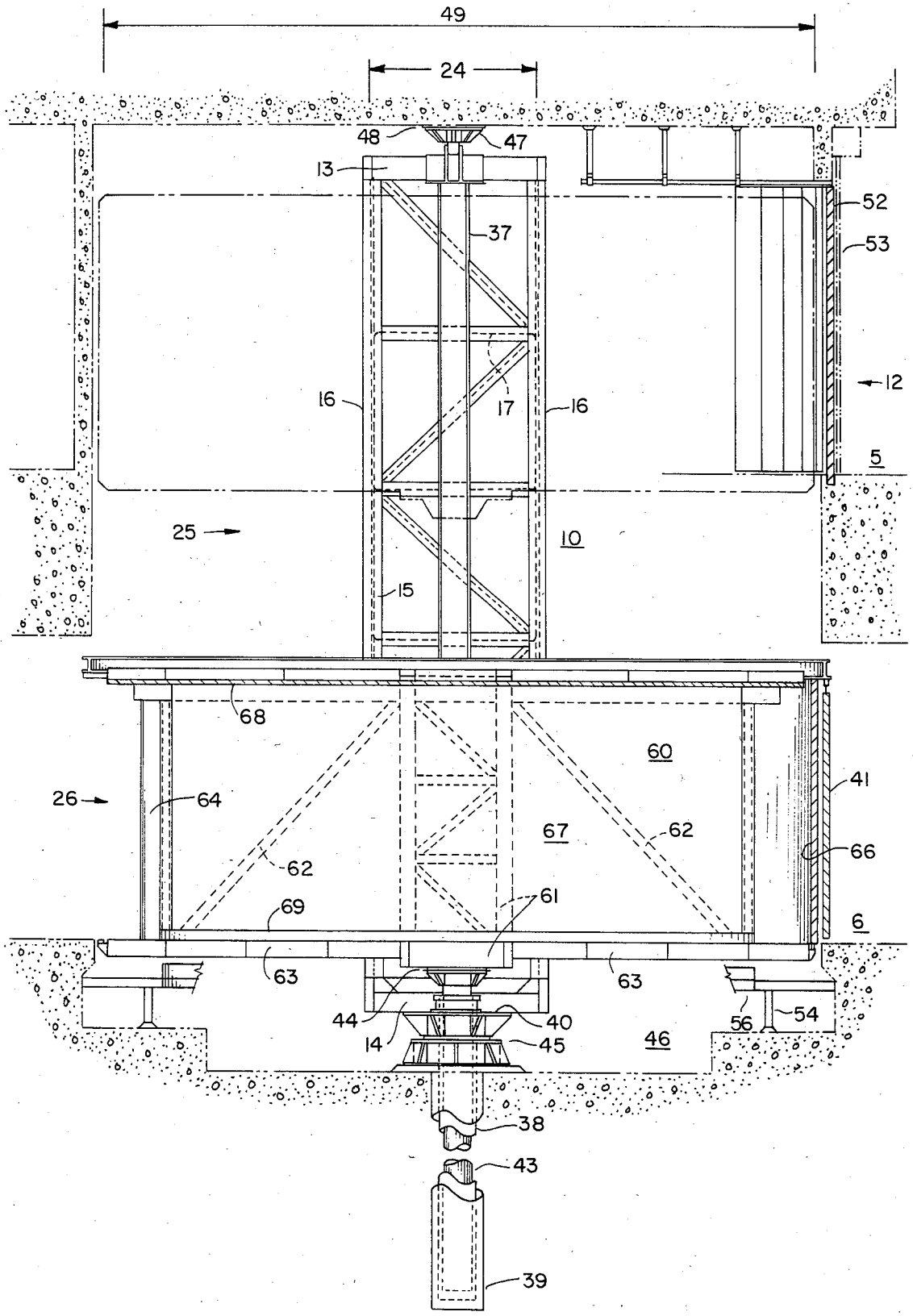
FIG. 3 is a vertical side view similar to FIG. 2.
Figure 5:
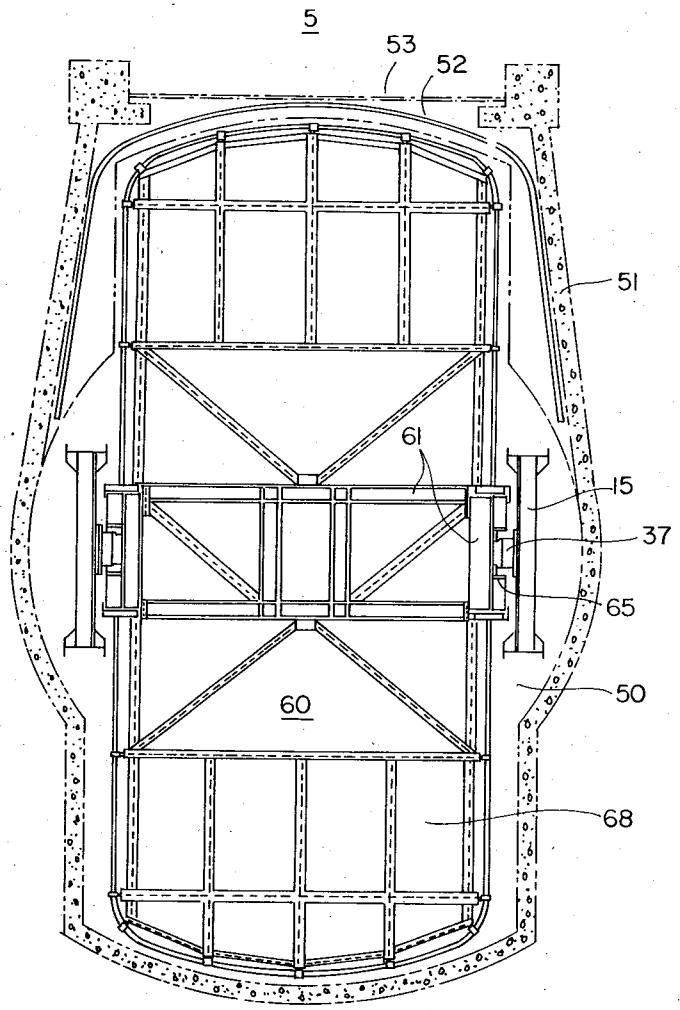
FIGS. 4 and 5 are partly sectional, partly schematic views along the lines 4—4 and 5—5, respectively, of FIG. 2.

I prefer to use as the lift drive a hydraulic piston 43 and cylinder 38. The cylinder 38 is secured at its upper end 40 to the top of the bearing 45 steel housing, and extends vertically downward within a cylindrical space 39 within or below the building foundation below the dock level 6 as shown in FIGS. 2 and 3. The cylinder piston 43 extends through an opening in the tower bottom frame 14 and is secured to the lift platform center frame 61 bottom at 44.

As mentioned, the hydraulic drive machinery 31 for the hydraulic lift cylinder is conveniently located within the lower cylindrical section, shown schematically at 30, 31 in FIG. 2, and FIG. 4 and consists of conventional motors, pumps 33 and suitable controls connected 55 to the hydraulic lift cylinder 38 for actuating same. Three pumps 33 are shown in the preferred configuration. This, together with proper valving and controls (not shown), allows the operation of the lift in case one or two pumps fail, at proportionately slower speeds, even by a single pump.

Various known rotating drives 32 can be provided for rotating the tower structure. As one example only, a circular steel plate 56 can be mounted 54 into the pit 46 engaged by suitable traction wheels 57, compressed against each other on opposite sides of circular plate 56 and against the plate 56 by springs (not shown). Spring pressure adjustment or drive disengagement is accomplished by means of crank 34. Traction wheels 57 are driven through gear reducers 35 slidably mounted on drive base 36 by a reversible hydraulic or electrical motor 58 mounted on the drive base. Two drive systems 32 are provided for redundancy. Only one drive rotates the tower structure 10 The other drive is a spare and remains disengaged.

Alternatively, a gear and pinion drive can be employed to rotate the tower structure 10.

Figure 6:
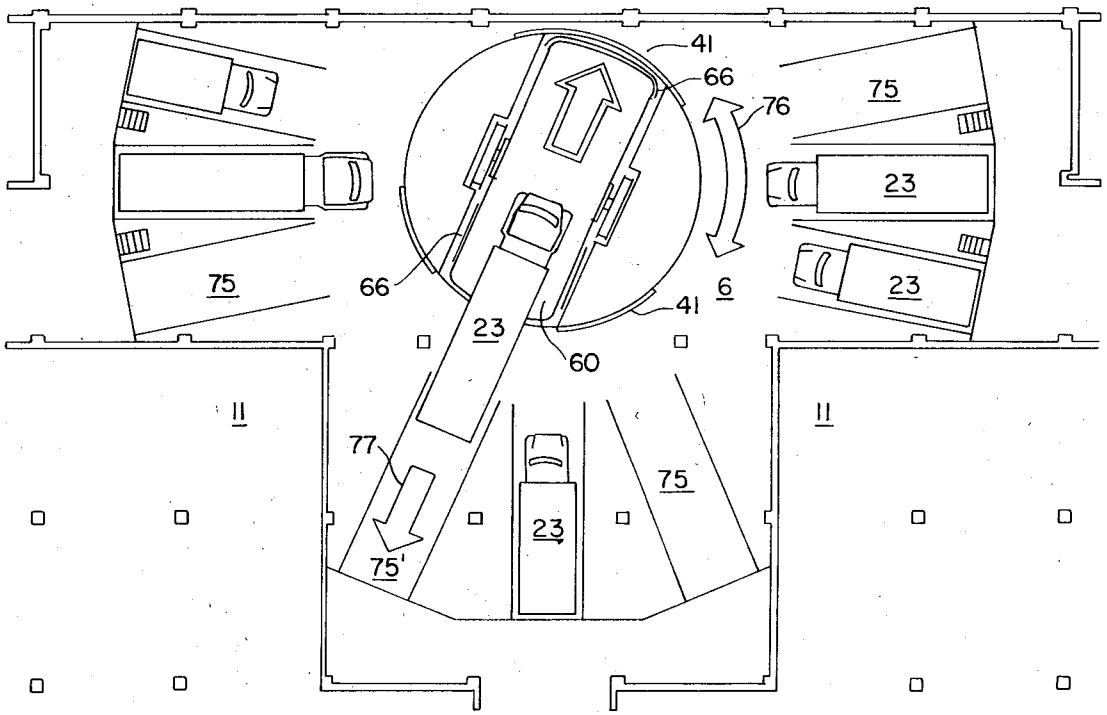
FIG. 6 illustrates operation of the inventive structure at dock level.
Figure 7:
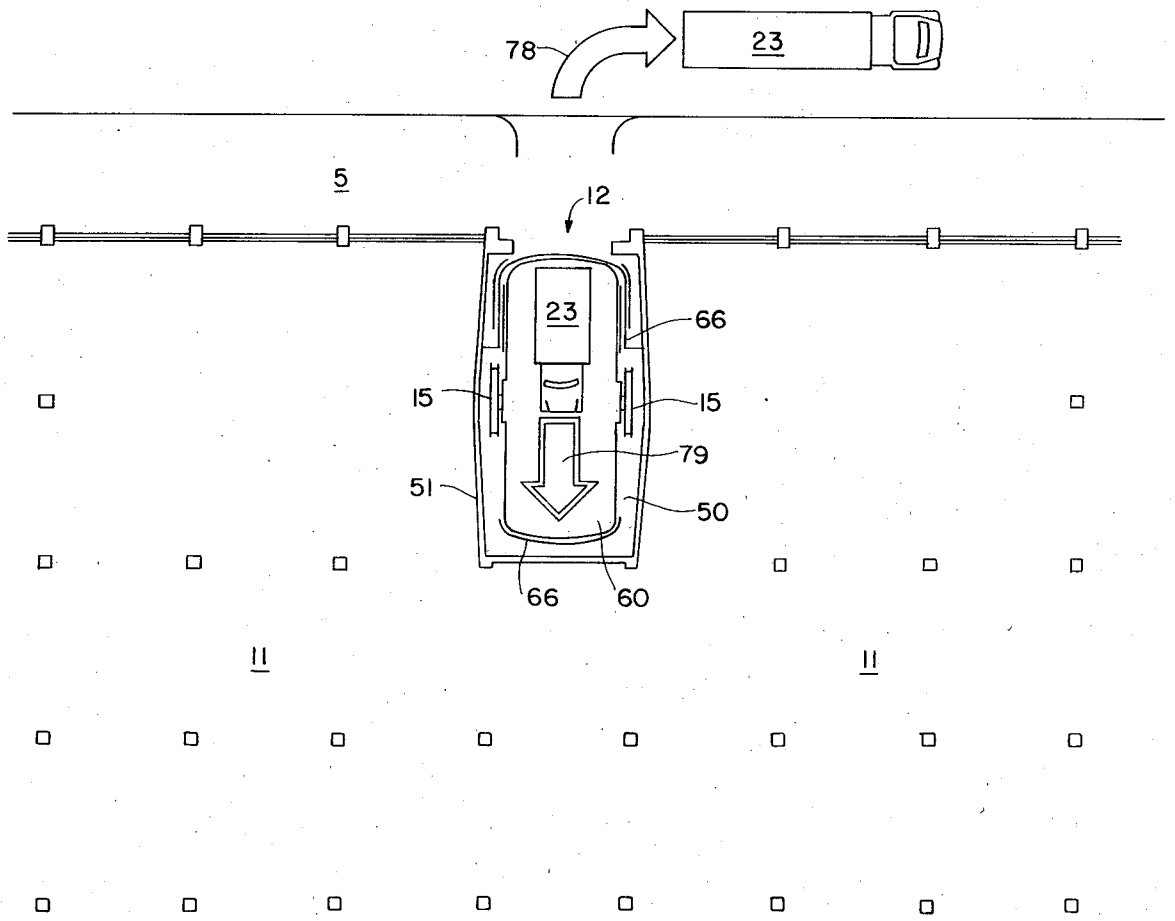
FIG. 7 illustrates operation at street level.

Operation of the system can best be understood with reference to FIGS. 1, 6 and 7.

The lift platform 60 is positioned at street level 5 and oriented so that one short end is aligned with the building truck entrance 12. It is understood that conventional safety controls can be provided that will prevent opening of the entrance doors 52 and the platform doors 66 until the properly oriented platform 60 has reached the street level 5. As shown by arrow 79 in FIG. 7, a truck 23 enters the building 11 through building entrance 12 and can be driven through open section doors 52, 53 and 66 onto the lift platform 60. A suitable locking mechanism is provided to lock the tower structure to the building and prevent rotation thereof as the lift platform 60 is raised from the loading dock 6 position. One suitable form is shown in FIG. 2 as a lock bar 70, hydraulic or motor driven, mounted to the underside of rotating tower floor frame grid 29, which rotates with the tower 10, which bar is adapted to engage with an end and lockingly engage when actuated the wall socket 71 fixed to the building 11 in pit 46. Suitable controls (not shown) can be provided to ensure that the rotatable tower can be stopped and locked in desired, selected rotary positions. For example, one tower rotary position where the tower must be locked to the building by lock bar 70 would be the position to receive or to disembark a truck at street level. Other positions where the tower may or may not be locked to the building by lock bar 70 would be located to position the tower so as to align the truck with various loading doors at the dock level 6.

Returning now to FIG. 7, with the tower locked, the truck 23 is driven directly onto the lift platform 60, the tower lift doors 66 and building entrance door 52 are closed, and the lift mechanism 31, 38 is actuated to lower the platform 60 and truck 23 to the dock level 6. The dock level (FIG. 6) can be configured, preferably in a generally circular fashion, to surround part or all of the lower cylindrical tower section. In this way, multiple docks 75 are made available for loading/unloading as many trucks 23 as desired. In the embodiment illustrated, nine dock areas 75 are depicted arranged over about a 210° arc with the bearing axis as center. This assumes that the street represents the limit of maximum expansion of the docking area. If space under the street is available or if the rotating truck lift is moved further inside the building, the docking area could be extended to a full 360° encircling the tower. Assuming the dock designated 75' is to be used, after the lift platform 60 has reached the loading dock 6 floor level, the lock bar 70 is disengaged and the tower structure is now rotated 76 by actuating the rotatable drive 32 until the back of the truck 23 is aligned with the dock 75'. The tower may now be locked to the building, the lift doors 66 and the cylindrical section doors 41 opened, and the truck 23 can then be backed off the lift straight into loading/unloading position within dock 75', as shown by arrow 77. Minimum truck maneuvering is necessary with my invention, and thus even the space required at the dock level can be kept to a minimum. The reverse procedure would be followed when a truck is to be moved from the dock level to the street level, with the lift platform 60 before lifting being suitably oriented with the hoistway 50 at street level, doors 66 and 41 being closed, tower structure 10 being locked to building 11 by lock bar 70, lift platform 60 being lifted to street level 5, and doors 66 and 52 being opened, and truck 23 can drive forward as shown by arrow 78 in FIG. 7 from the lift platform, out the entrance door directly into the street 5. All system controls can be electrically and/or mechanically interlocked so as to prevent damage to personnel and equipment when all operating and safety conditions are not satisfied.

The preferred embodiment of my rotating truck lift system is shown with the loading dock below the street level, with the lift hydraulic cylinder mounted to the rotating tower bottom bearing, and with all the controls and machinery mounted into the cylindrical structure. Other configurations and their combinations are possible to suit specific requirements within the principles of my invention as enunciated above. For example, the loading dock and cylindrical portion of the rotating tower structure can be above the street level, in which case the upper and lower tower sections would be reversed. The lift hydraulic cylinder can be mounted fixed, not on the bearing as shown. In this case, suitable means would be provided to disengage the cylinder from the lift platform when the platform together with the tower structure rotates. For this particular modification, the hydraulic power unit would not be mounted into the rotating structure, but elsewhere in the vicinity of the building. The hydraulic lift system for the platform can be replaced or supplemented by a cable hoist system, or by a ball or ACME screw-type lift system. The rotating tower turntable drives can be placed in the pit or above, or suspended from the ceiling, instead of being mounted on the lower cylindrical section of the tower structure. The safety devices and controls can be placed elsewhere in the building, depending on the arrangement of the lift and the tower drive systems. If desired, counter-weights can be added to the system to balance most of the weight of the lift platform. This would reduce lift power requirements. Other possible variations will be evident to those skilled in the art.

Further, while my invention is best suited for a truck loading and unloading situation, the rotating lift structure could also be used, for example, in a circular parking structure affording a narrow street level entrance for vehicles to be parked, with circular bays provided at multiple levels above and below street level into which the vehicles can be parked in a circular array around the tower with little space needed at the parking levels for maneuvering the vehicles into and out of the lift and parking spaces.

The benefits offered by my invention have already been described or will be evident from the foregoing description, and, briefly summarized, requires little building space at street level to receive or discharge a truck or other vehicle, relocates the large dock level below or above street level where space is less expensive, and utilizes a rotatable tower structure with integral lift for moving and orienting the truck or other vehicle between the street level entrance and the docking areas at the dock level.

While my invention has been described in connection with specific embodiments thereof, those skilled in the art will recognize that various modifications are possible within the principles enunciated herein and thus the present invention is not to be limited to the specific embodiments disclosed.

What is claimed is:

1. A rotating lift comprising a vertically-oriented structure tower extending from a first level to a second level, a lift platform mounted within the tower such that said platform is capable of only vertical displacement relative to said tower, lift means connected to the platform for vertically moving said platform within the tower between a first position horizontally aligned with the first level and a second position vertically aligned with said first position and horizontally aligned with the second level, bearing means for rotatably supporting said tower, and means for rotating said tower over a given angular range, said lift platform being arranged such that an axis of rotation of said tower passes through said lift platform.

2. A rotating lift for a building adapted for receiving a vehicle at a first level via a narrow entranceway and raising or lowering the vehicle to a second level for egress of the vehicle selectively over a wide angular range, comprising a vertically-oriented structural tower having at the first level a relatively narrow section having a width and length sized to receive said vehicle and having at the second level a generally cylindrical section vertically aligned with the narrow section, a lift platform for receiving the vehicle and mounted within the tower such that said platform is capable of only vertical displacement relative to said tower, lift means connected to the platform for vertically moving said platform within the tower between a first position horizontally aligned with the first level and a second position vertically aligned with said first position and horizontally aligned with the second level, bearing means for rotatably supporting said tower within the building, and means for rotating said tower within the building over said wide angular range, said lift platform being arranged such that an axis of rotation of said tower passes through said lift platform.

3. A rotating lift for a building as claimed in claim 2, wherein the tower comprises a structural frame mounted on the bearing means, and the lift platform is mounted for vertical movement on the structural frame.

4. A rotating lift for a building as claimed in claim 3, wherein the cylindrical section is secured to and supported by the said structural frame.

5. A rotating lift for a building as claimed in claim 4, wherein the lift means for the platform and the rotating means for the tower are housed within the cylindrical section.

6. A rotating lift for a building as claimed in claim 3, wherein the lift means comprises a hydraulic cylinder mounted below and connected to the tower for rotation therewith.

7. In combination with a building having a narrow entrance at street level for receiving a vehicle and at a level below or above street level a relatively broad docking area having multiple docks for loading and unloading of the vehicle, a rotating lift structure mounted within the building for selectively moving the vehicle between the street and docking levels, said lift structure comprising a vertically-oriented structural tower having at the street level a relatively narrow section having a width and length sized to receive said vehicle and having at the docking level a generally cylindrical section vertically aligned with the narrow section, a platform for receiving the vehicle and mounted with the tower such that said platform is capable of only vertical displacement relative to said tower, lift means connected to the platform for vertically moving said platform between a first position horizontally aligned with the street level and a second position horizontally aligned with the docking level, bearing means for rotatably supporting said tower within the building, and means for rotating said tower within the building over an angular range sufficient to allow the vehicle to move directly into any of the multiple docks, said lift platform being arranged such that an axis of rotation of said tower passes through said lift platform.

8. The combination of claim 7, wherein the building floor at the docking level has a generally circular configuration matching that of the cylindrical section.

9. The combination of claim 7 and further comprising means for selectively locking the tower to the building at selected angular tower positions to prevent rotation thereof when so locked during ingress or egress of a vehicle to or from the platform.

10. The combination of claim 7 wherein the tower is constructed to be rotatable over an angular range of at least 150°, and the docks are arranged in a generally circular configuration around the tower.

11. The combination of claim 7 and further comprising lift doors closing off opposite ends of the lift platform and further doors at opposite ends of the cylindrical section aligned with said lift doors.

12. The combination of claim 7 wherein the tower comprises a generally rectangular frame arranged in a vertical plane, and the lift platform has a width corresponding to the frame width and a larger length extending generally perpendicular to the said vertical plane and approximately equal to the diameter of the cylindrical section.

13. The combination of claim 7 and further comprising doors at opposite ends of the lift platform and wherein said rotating means comprises plural drive means.

14. The combination of claim 7 wherein said rotating means comprises a circular member fixed to the tower bottom and rotary drive means for engaging the circular member.

15. A rotating lift comprising a structural tower having a substantially vertical section extending from a first level to a second level, a lift platform slidably mounted within and extending outside said substantially vertical section of said tower and capable of vertical displacement between a first position horizontally aligned with said first level and a second position horizontally aligned with said second level, lift means coupled to said lift platform for vertically displacing said platform between said first and second positions, bearing means arranged to rotatably support said tower, drive means for rotating said tower over a predetermined angular range, and means for preventing rotation of said tower when said lift platform is raised, said lift platform and said tower being arranged such that an axis of rotation of said tower passes through said lift platform and such that said tower is rotatable when said lift platform is in said second position and said tower is not rotatable when said lift platform is not in said second position.

16. The rotating lift of claim 15, further comprising means for locking said tower at predetermined angular positions to prevent rotation.

17. The rotating lift of claim 15, wherein said platform is sized to enable the placement of a vehicle thereon.

18. The rotating lift of claim 15, wherein said lift means comprises at least one hydraulic cylinder.

19. The rotating lift of claim 15, wherein said axis of rotation is located substantially at the center of said lift platform.

* * * * *